US006817417B2

(12) United States Patent
Blair et al.

(10) Patent No.: US 6,817,417 B2
(45) Date of Patent: Nov. 16, 2004

(54) DEBRIS CAP

(75) Inventors: Richard Blair, Cumbernauld (GB); William Crawford, Muireston (GB); Martin Forsyth, Kirkmuirhill (GB); Graeme J. Collie, Dunfemline (GB); Kevin N. Hannigan, St. Johns (CA)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/087,873

(22) Filed: Mar. 1, 2002

(65) Prior Publication Data

US 2002/0185279 A1 Dec. 12, 2002

(30) Foreign Application Priority Data

Mar. 2, 2001 (GB) ..... 0105307

(51) Int. Cl.[7] ..... E21B 29/12

(52) U.S. Cl. ..... 166/335; 166/341; 166/343; 166/360

(58) Field of Search ..... 166/335, 339–341, 166/343, 360, 368

(56) References Cited

U.S. PATENT DOCUMENTS 2,970,646 A * 2/1961 Knapp et al. ..... 166/352
3,063,500 A * 11/1962 Logan ..... 166/351
3,592,263 A * 7/1971 Nelson ..... 166/356
3,675,719 A * 7/1972 Slator et al. ..... 166/297
3,945,213 A * 3/1976 Forbes et al. ..... 405/215
4,799,554 A * 1/1989 Clapp et al. ..... 166/312
5,005,650 A * 4/1991 Hopper ..... 166/339
5,050,680 A * 9/1991 Diehl et al. ..... 166/356
5,107,931 A 4/1992 Valka et al.
5,988,282 A * 11/1999 Jennings et al. ..... 166/348
5,992,526 A * 11/1999 Cunningham et al. ..... 166/343

FOREIGN PATENT DOCUMENTS

GB 1 315 561 5/1973
WO WO 99/28593 A1 6/1999

* cited by examiner

*Primary Examiner*—Thomas B. Will
*Assistant Examiner*—Thomas A Beach
(74) *Attorney, Agent, or Firm*—Henry C. Query, Jr.

(57) ABSTRACT

An ROV, wireline or diver installed subsea xmas tree debris cap has an integral corrosion inhibitor/biocide provided in the form of a solid block which is wrapped in a water soluble membrane bag. The block is suspended inside the debris cap in a basket or perforated container. After installation of the debris cap, the membrane and solid block will dissolve and sanitize the stagnant water, thereby protecting all materials from corrosion for a number of years. The debris cap also includes an environmental seal in the form of a single O ring. Furthermore, the debris cap is simplified in that it does not include a conventional debris cap-to-xmas tree lockdown mechanism.

15 Claims, 2 Drawing Sheets

DEBRIS CAP

BACKGROUND OF THE INVENTION

This invention relates to debris caps for subsea wellheads and xmas trees.

In the exploitation of offshore oilfields, after a well is drilled, it may be left for several months, or even years, before it is completed and placed into production mode ("temporary abandonment"). Similarly, a subsea xmas tree may not be used for production immediately after it has been installed at the wellhead. In such circumstances there is a need to protect upper external and internal wellhead and subsea xmas tree sealing surfaces, locking profiles and other vulnerable components against corrosion. Protection against damage or obstruction by falling debris, silt and biological accretions is also required.

For these purposes a debris cap will be installed on the upper end of the wellhead housing or xmas tree. It is deployed by wireline using a special running tool. A ROV actuated lockdown mechanism is used to secure the cap in place. The ROV is also used to deliver, to the volume of stagnant seawater trapped beneath the cap, via an umbilical connection, a solution containing corrosion inhibitors and biocides. This provides corrosion protection for the various types of materials within the stagnant volume as required (for example AISI 8630 steels, Inconel® 718 and 625 alloys, elastomers such as HNBR, PTFE or plastics such as Devlon® V-API). The biocide will also inhibit bacterial growth.

Feedback from customers and end users has highlighted certain flaws with the existing design of debris caps. Their installation procedures are relatively complex and time consuming, involving use of the wireline running tool, followed by ROV manipulation of the lockdown mechanism and connection/disconnection of the corrosion inhibitor delivery umbilical. The complexity can lead to unexpected installation difficulties, still further increasing the required ROV deployment time.

SUMMARY OF THE INVENTION

It is an objective of the invention to eliminate the use of an umbilical line or an ROV to pump corrosion inhibitor into the stagnant volume beneath a debris cap. Accordingly the present invention provides a debris cap for a subsea xmas tree or wellhead, comprising container that can be pre-charged with corrosion inhibitor and/or biocide prior to installation subsea, and which releases the corrosion inhibitor/biocide into a stagnant volume enclosed beneath the cap following installation. Preferably the debris cap can be run on wireline alone or deployed by an ROV alone, advantageously with no need for a special running tool or any lockdown mechanisms. This will result in installation time and ROV deployment time being shorter. The preferred debris cap of the invention may also be diver installable without the use of special tools.

For a fuller understanding of the invention and its preferred features, illustrative embodiments are described below with reference to the drawings.

DESCRIPTION OF THE PREFERRED EMBODIMENTS

Figure 1:
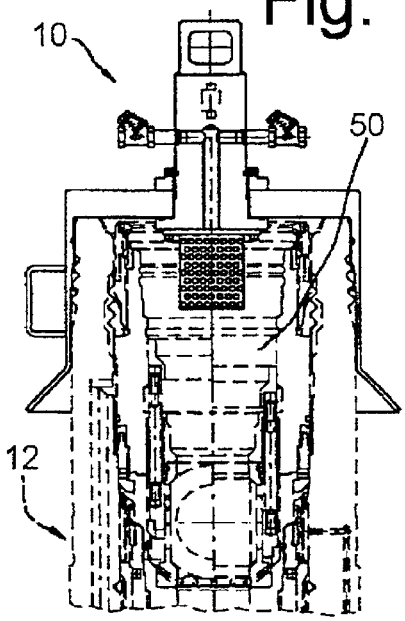
FIG. 1 shows a debris cap embodying the invention installed on the upper end of a subsea xmas tree.
Figure 2:
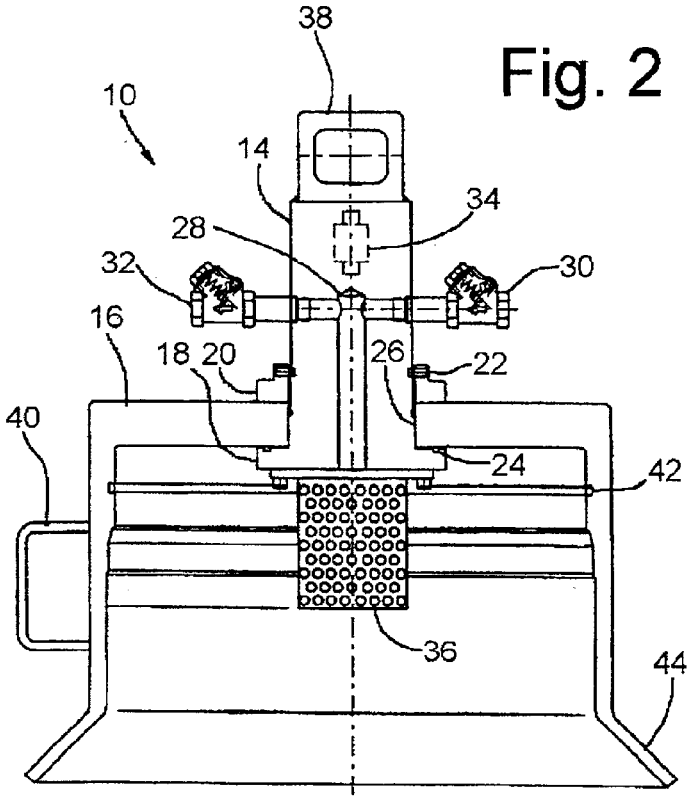
FIG. 2 is an enlarged view showing further details of the tree cap of FIG. 1.

Referring to FIG. 1, a debris cap 10 is shown installed on the upper end of a subsea xmas tree 12. The cap makes a seal with the outer circumference of the xmas tree, to enclose a stagnant volume 50 of seawater. As shown more particularly in FIG. 2, the cap 10 comprises a central boss 14 and a hood 16, both fabricated from a suitable metal, for example stainless steel. The hood is secured in tight engagement with a flange 18 on the boss 14, by a collar 20 and grub screws 22. An O ring 24 makes a fluid tight seal between the flange 18 and a central hole 26 in the hood 16 in which the boss 14 is received. The boss 14 contains a T-shaped passageway 28 whose stem communicates with the interior of the hood 16, and whose other ends are provided with inlet 30 and outlet 32 valves, to allow displacement of seawater as the cap 10 is removed from or installed upon the tree 12. Fluid hoses may be connected to the valves 30, 32 to allow flushing of the stagnant volume 50 (including injection of corrosion inhibitor/biocide in the conventional manner) if required. A sacrificial anode 34 is attached to the boss 14, to provide electrolytic protection for the cap 10. A perforated container 36 is bolted to the boss 14 within the hood 16. Prior to running the cap 10, the container is charged with a solid block of corrosion inhibitor and/or biocide (not shown). This may be wrapped in water soluble membrane bags which dissolve sequentially in use, to release the corrosion inhibitor/biocide over an extended period. The stagnant volume is therefore kept sanitized, protecting the surrounding materials against corrosion and bacterial activity for a number of years, if needed. The biocide blocks can be constructed and formulated having regard to the volume/surface areas to be kept sanitized and the anticipated abandonment time. For example the block may weigh between 25 g and 25 kg and may comprise Blairchem B220 solid biocide, available from Blairchem Limited, Karibu, Blairs, Aberdeen, AB12 5YT, Scotland. The upper end of the boss 14 carries a lifting eye 38 for engagement by a ROV tool or wireline. The hood is provided with a handle 40, a flared skirt 44 for guiding it into engagement with the tree 10 upper end, and an inner circumferential O ring seal 42. This environmental seal 42 not only seals the cap 10 against the tree outer circumference, but also frictionally engages the tree 12 and, together with the suction effect of the substantially sealed internal volume 50, helps to keep the cap 10 in place. No additional lockdown mechanism is required, greatly simplifying installation procedures. Use of a pre-fitted solid biocide block also eliminates the need to inject biocide/corrosion inhibitor via an umbilical. The cap 10 is therefore relatively simple to install or remove, by wireline, ROV or diver.

Figure 3:
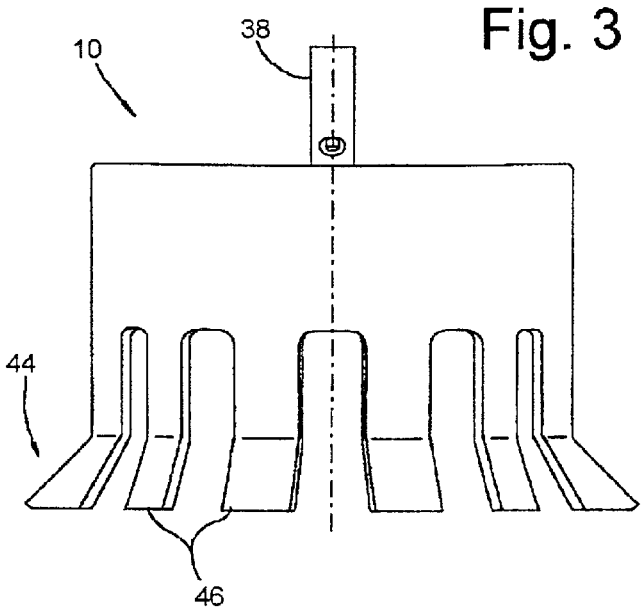
FIG. 3 shows a second embodiment of the tree cap of the present invention.
Figure 4:
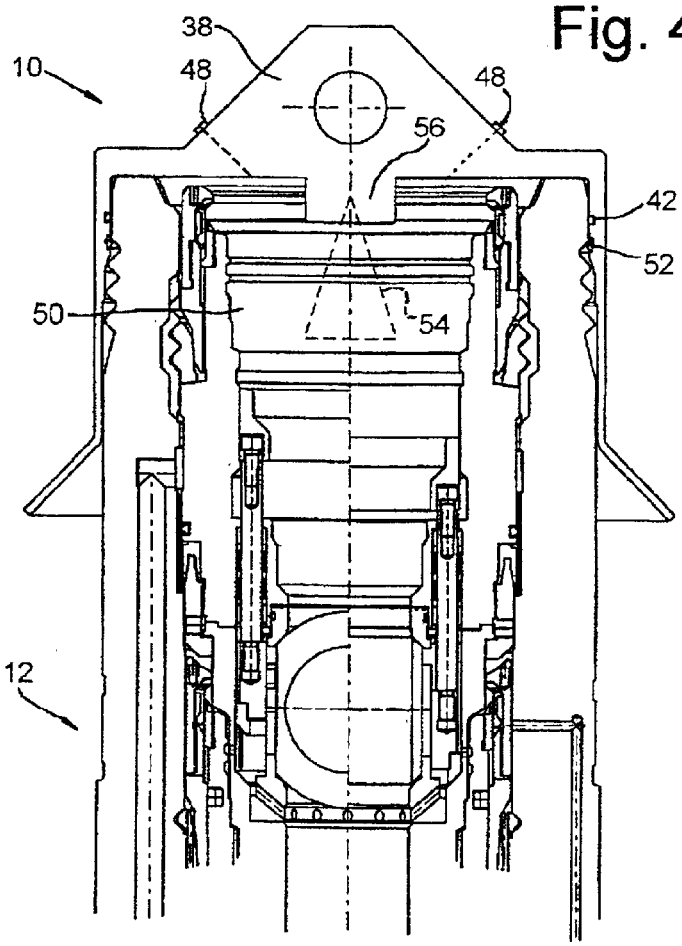
FIG. 4 shows the tree cap of FIG. 3 installed on a subsea xmas tree.

FIG. 3 shows a second embodiment of the debris cap 10, formed from a single injection molding of e.g. Devlon® V or other suitable plastics material. The lower end and skirt 44 of the cap 10 are divided into a number of axially extending fingers 46, which frictionally grip the tree 12 upper end. FIG. 4 is a sectional view showing the cap 10 in place on the tree 12, rotated 90° about its longitudinal axis compared to FIG. 3. A lifting eye 38 is integrally molded with the cap 10. A pair of low crack pressure check valves 48 communicate with the interior volume 50, to allow water displacement during cap installation/retrieval. The cap 10 is sealed to the tree by an inner circumferential O ring seal 42 and a lower L-profile seal 52. The seal 52 engages the uppermost groove of the tree upper locking profile. Together with the seal 42 and fingers 46 it serves to frictionally retain the cap in position on the tree 12. The cap 10 is also retained by the above mentioned suction effect. A wire basket schematically indicated at 54 is suspended inside the cap 10 from an integrally molded boss 56, to contain and slowly release the corrosion inhibitor/biocide, as the block (not shown) dissolves.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. A debris cap for a subsea xmas tree or a wellhead, the debris cap comprising:

a container which is supported directly by the debris cap and which is pre-charged with at least one of a corrosion inhibitor and a biocide prior to installation of the debris cap on the xmas tree or the wellhead;

wherein after installation the debris cap is directly supported on the xmas tree or the wellhead; and wherein the at least one of the corrosion inhibitor and the biocide is released into a stagnant volume enclosed beneath the debris cap following installation of the debris cap on the xmas tree or the wellhead.

2. A debris cap as defined in claim 1, wherein the debris cap is frictionally retained on the xmas tree or the wellhead without the use of a lockdown mechanism.

3. A debris cap as defined in claim 1, further comprising an O ring environmental seal which engages the xmas tree or the wellhead.

4. A debris cap as defined in claim 1, wherein the at least one of the corrosion inhibitor and the biocide comprises a solid block and the debris cap further comprises a perforated container for holding the solid block.

5. A debris cap as defined in claim 1, wherein the at least one of the corrosion inhibitor and the biocide comprises a solid block and the debris cap further comprises a wire basket for holding the solid block.

6. A debris cap as defined in claim 1, further comprising at least one finger for frictionally gripping the xmas tree or the wellhead.

7. A debris cap as defined in claim 1, further comprising a valve for allowing water displacement during installation or retrieval of the debris cap.

8. A debris cap as defined in claim 1, further comprising a central boss and a surrounding hood.

9. A debris cap as defined in claim 1, wherein the debris cap is molded from a plastic material.

10. A debris cap for a subsea xmas tree or a wellhead, the debris cap comprising:

a container which is pre-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the debris cap is frictionally retained on the xmas tree or the wellhead without the use of a lockdown mechanism.

11. A debris cap for a subsea xmas tree or a wellhead, the debris cap comprising:

a container which is pre-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the debris cap further comprises an O ring environmental seal which engages the xmas tree or wellhead.

12. A debris cap for a subsea xmas tree or a wellhead, the debris cap comprising:

a container which is pre-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the at least one of the corrosion inhibitor and the biocide comprises a solid block and the debris cap further comprises at least one of a perforated container and a wire basket for holding the solid block.

13. A debris cap for a subsea xmas tree or a wellhead, the debris cap comprising:

a container which is pre-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the debris cap further comprises at least one finger for frictionally gripping the xmas tree or wellhead.

14. A debris cap for a subsea xmas tree or a wellhead, the debris cap comprising:

a container which is pre-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the debris cap further comprises a central boss and a surrounding hood.

15. A debris cap for a subsea xmas tree or a wellhead, the debris cap comprising:

a container which is pro-charged with at least one of a corrosion inhibitor and a biocide prior to installation of the debris cap on the xmas tree or the wellhead;

wherein after installation the debris cap is supported on the xmas tree or the wellhead;

wherein the at least one of the corrosion inhibitor and the biocide is released into a stagnant volume enclosed beneath the debris cap following installation of the debris cap on the xmas tree or the wellhead; and wherein the debris cap is molded from a plastic material.

* * * * *